US010781086B2

(12) United States Patent
August et al.

(10) Patent No.: US 10,781,086 B2
(45) Date of Patent: Sep. 22, 2020

(54) WINCHES WITH DUAL MODE REMOTE CONTROL, AND ASSOCIATED SYSTEMS AND METHODS

(71) Applicant: Westin Automotive Products, Inc., San Dimas, CA (US)

(72) Inventors: Jacob August, Sherwood, OR (US); Ron Dennis, Woodburn, OR (US); Timothy Frazier, Beaverton, OR (US); Jon Mason, Old Saybrook, CT (US); Scott Salmon, Dayville, CT (US); Ty Hargroder, Los Angeles, CA (US); David Scuito, Molalla, OR (US); David Burns, Wilsonville, OR (US); Brent Nasset, Salem, OR (US)

(73) Assignee: Westin Automotive Products, Inc., San Dimas, CA (US)

( * ) Notice: Subject to any disclaimer, the term of this patent is extended or adjusted under 35 U.S.C. 154(b) by 507 days.

(21) Appl. No.: 15/793,451

(22) Filed: Oct. 25, 2017

(65) Prior Publication Data

US 2018/0170725 A1 Jun. 21, 2018

Related U.S. Application Data

(60) Provisional application No. 62/414,909, filed on Oct. 31, 2016.

(51) Int. Cl.
*B66D 1/46* (2006.01)
*G08C 17/02* (2006.01)
(Continued)

(52) U.S. Cl.
CPC ..... *B66D 1/46* (2013.01); *B66D 1/12* (2013.01); *B66D 3/006* (2013.01); *G08C 17/02* (2013.01)

(58) Field of Classification Search
CPC ..... B66D 3/006; G08C 17/02
See application file for complete search history.

(56) References Cited

U.S. PATENT DOCUMENTS 2,361,858 A 10/1944 Maginniss
3,740,694 A 6/1973 Fisher
(Continued)

FOREIGN PATENT DOCUMENTS

CN 103465877 12/2013
DE 102012218463 4/2014
(Continued)

OTHER PUBLICATIONS

U.S. Appl. No. 14/735,674, filed Jun. 10, 2015, Mason.
(Continued)

*Primary Examiner* — Sang K Kim
*Assistant Examiner* — Nathaniel L Adams
(74) *Attorney, Agent, or Firm* — The Dobrusin Law Firm, PC

(57) ABSTRACT

Winches with dual mode remote controls, and associated systems and methods are disclosed. A representative winch can include a frame, a cable drum rotatably supported by the frame, a drive motor operatively connected to the cable drum, and a winch control module. The winch control module can include an enable/disable circuit having a normally open ground path connection and a controller having wireless capability connected to the enable/disable circuit. The controller can include instructions to disable the wireless capability of the controller when the normally open ground path connection is completed.

10 Claims, 6 Drawing Sheets

(51) Int. Cl.
*B66D 1/12* (2006.01)
*B66D 3/00* (2006.01)

(56) References Cited

U.S. PATENT DOCUMENTS

| | | | | |
|---|---|---|---|---|
| 4,004,780 | A | 1/1977 | Kuzarov | |
| 4,307,925 | A | 12/1981 | Drew | |
| 4,475,163 | A | 10/1984 | Chandler et al. | |
| 5,167,535 | A | 12/1992 | Kovacik et al. | |
| 5,211,570 | A | 5/1993 | Bitney | |
| 5,783,986 | A | 7/1998 | Huang | |
| 5,995,347 | A | 11/1999 | Rudd et al. | |
| 6,210,036 | B1 | 4/2001 | Eberle et al. | |
| 6,358,076 | B1 | 3/2002 | Haag | |
| D471,338 | S | 3/2003 | Hodge | |
| D473,992 | S | 4/2003 | Hodge | |
| D489,157 | S | 4/2004 | Lawson | |
| 6,864,650 | B2 | 3/2005 | Heravi et al. | |
| 6,882,917 | B2 | 4/2005 | Pillar | |
| 6,885,920 | B2 | 4/2005 | Yakes et al. | |
| D513,650 | S | 1/2006 | Elliott | |
| 6,995,682 | B1 * | 2/2006 | Chen | B66D 1/46 340/12.22 |
| 7,021,968 | B1 | 4/2006 | Lu | |
| 7,063,306 | B2 | 6/2006 | Sanders et al. | |
| D532,577 | S | 11/2006 | Elliott et al. | |
| 7,184,866 | B2 | 2/2007 | Squires et al. | |
| 7,201,366 | B2 | 4/2007 | Sanders et al. | |
| D550,923 | S | 9/2007 | Huang | |
| D555,874 | S | 11/2007 | Elliott et al. | |
| 7,392,122 | B2 | 6/2008 | Pillar | |
| 7,511,443 | B2 | 3/2009 | Townsend et al. | |
| D599,524 | S | 9/2009 | Averill et al. | |
| 7,613,003 | B2 | 11/2009 | Pavlovic et al. | |
| 7,705,706 | B2 | 4/2010 | Ding | |
| 7,770,847 | B1 | 8/2010 | Severson | |
| 7,891,641 | B1 | 2/2011 | Miller | |
| 7,984,894 | B1 | 7/2011 | Chauza | |
| 7,985,098 | B2 | 7/2011 | De Chazal et al. | |
| 8,055,403 | B2 | 11/2011 | Lowrey et al. | |
| 8,076,885 | B2 | 12/2011 | Heravi et al. | |
| 8,221,165 | B2 | 7/2012 | DeWitte | |
| 8,248,230 | B2 | 8/2012 | Covaro | |
| D670,660 | S | 11/2012 | Cook | |
| 8,306,690 | B2 | 11/2012 | Bertness et al. | |
| 8,328,581 | B2 | 12/2012 | De Chazal | |
| D685,750 | S | 7/2013 | Nakagawa | |
| 8,554,440 | B1 | 10/2013 | Davis | |
| D703,414 | S | 4/2014 | Fretz et al. | |
| 8,723,477 | B2 | 5/2014 | Gual et al. | |
| 8,820,718 | B2 | 9/2014 | Weidner | |
| 8,944,217 | B2 | 2/2015 | Anasis | |
| 8,944,413 | B1 | 2/2015 | Hatch et al. | |
| 8,958,956 | B1 | 2/2015 | Felps | |
| 9,011,180 | B2 | 4/2015 | Sharaf et al. | |
| 9,014,913 | B2 | 4/2015 | Heravi et al. | |
| 9,124,021 | B2 | 9/2015 | Kashiwada et al. | |
| D740,513 | S | 10/2015 | Fretz et al. | |
| D741,038 | S | 10/2015 | Huang | |
| 9,315,364 | B2 | 4/2016 | Averill et al. | |
| D766,843 | S | 9/2016 | Fretz et al. | |
| D776,395 | S | 1/2017 | Fretz et al. | |
| 9,537,335 | B2 | 1/2017 | Furui et al. | |
| D779,768 | S | 2/2017 | Fretz et al. | |
| D784,934 | S | 4/2017 | Fretz et al. | |
| D799,143 | S | 10/2017 | Cui | |
| D799,144 | S | 10/2017 | Cui | |
| 9,779,557 | B2 | 10/2017 | Hauser et al. | |
| 9,810,704 | B2 | 11/2017 | Holmes | |
| D811,683 | S | 2/2018 | Frazier | |
| D811,684 | S | 2/2018 | Fretz et al. | |
| D811,685 | S | 2/2018 | Fretz et al. | |
| 9,923,311 | B2 | 3/2018 | Blakborn | |
| D815,386 | S | 4/2018 | August | |
| D816,937 | S | 5/2018 | Fretz et al. | |
| D816,938 | S | 5/2018 | Fretz et al. | |
| 9,975,742 | B1 | 5/2018 | Mason | |
| 2002/0156574 | A1 | 10/2002 | Fortin | |
| 2008/0001132 | A1 | 1/2008 | Huang et al. | |
| 2008/0166430 | A1 | 7/2008 | Doyle et al. | |
| 2009/0284877 | A1 | 11/2009 | Heravi et al. | |
| 2010/0319910 | A1 | 12/2010 | Ives et al. | |
| 2011/0065546 | A1 | 3/2011 | Xie et al. | |
| 2011/0104940 | A1 | 5/2011 | Rabu et al. | |
| 2013/0154821 | A1 | 6/2013 | Miller et al. | |
| 2013/0304278 | A1 | 11/2013 | Chen | |
| 2014/0001427 | A1 | 1/2014 | Fretz et al. | |
| 2014/0113500 | A1 | 4/2014 | Goyal et al. | |
| 2014/0193990 | A1 | 7/2014 | Zhao et al. | |
| 2014/0252286 | A1 | 9/2014 | Averill et al. | |
| 2014/0257631 | A1 | 9/2014 | Heravi et al. | |
| 2015/0140849 | A1 | 5/2015 | Goyal et al. | |
| 2015/0191334 | A1 | 7/2015 | Heravi et al. | |
| 2015/0298597 | A1 | 10/2015 | Salter et al. | |
| 2015/0307332 | A1 | 10/2015 | Huang | |
| 2015/0379783 | A1 | 12/2015 | Sallee et al. | |
| 2016/0046468 | A1 | 2/2016 | Heravi et al. | |
| 2016/0104974 | A1 | 4/2016 | Yamaguchi | |
| 2016/0233625 | A1 | 8/2016 | Kato et al. | |
| 2016/0311667 | A1 | 10/2016 | Huang | |
| 2016/0311668 | A1 | 10/2016 | Huang | |
| 2017/0062148 | A1 | 3/2017 | Legel | |
| 2017/0320709 | A1 | 11/2017 | Frazier et al. | |
| 2017/0321851 | A1 | 11/2017 | Fretz et al. | |
| 2018/0118528 | A1 | 5/2018 | August | |
| 2018/0118530 | A1 | 5/2018 | August | |
| 2018/0127246 | A1 | 5/2018 | Fretz et al. | |
| 2018/0170726 | A1 | 6/2018 | August et al. | |

FOREIGN PATENT DOCUMENTS

| | | |
|---|---|---|
| DE | 102015215664 | 2/2016 |
| EP | 2266915 | 12/2010 |
| EP | 3018088 | 5/2016 |
| GB | 2486265 | 6/2012 |
| WO | WO-2016046898 | 3/2016 |
| WO | WO-2016112980 | 7/2016 |

OTHER PUBLICATIONS

U.S. Appl. No. 15/640,091, filed Jun. 30, 2017, Dennis.
U.S. Appl. No. 15/722,234, filed Oct. 2, 2017, Karambelas.
U.S. Appl. No. 15/722,396, filed Oct. 2, 2017, August.
U.S. Appl. No. 15/724,652, filed Oct. 4, 2017, August.
U.S. Appl. No. 15/724,756, filed Oct. 4, 2017, August.
U.S. Appl. No. 16/793,451, filed Oct. 25, 2017, August.
U.S. Appl. No. 15/793,544, filed Oct. 25, 2017, August.
U.S. Appl. No. 29/563,917, filed Nov. 14, 2017, August.
U.S. Appl. No. 29/563,921, filed May 9, 2016, Frazier.
U.S. Appl. No. 29/579,766, filed Oct. 3, 2016, August.
"Automotive Winch Intruction Manual," Comeup Industries ; Inc., http://www.comeup.com/Archive_eng/all_pdf_eng/Comeup_Automotive_Winch_Instruction_Manual-eng.pdf, Aug. 1, 2013, 22 pages.
Superwinch, "Superwinch SI Industrial Winches," YouTube, https://www.youtube.com/watch?v=bMiDddvCZgs>, accessed Nov. 21, 2016, 1 page.
"The Comeup Cone Brake Structure," COMEUP USA, http://comeupusa.com/2017/04/the-comeup-cone-brake-structure/, Apr. 28, 2017, 2 pages.
Superwinch, "Super winch SI 8,000," Sep. 5, 2018, http://superwinch.com/pages/superwinch-si-line-of-industrial-winches, 2018, 2 pages.
Mscdirect, "Superwinch 15,000lb Capacity, Hydraulic Winch," https://www.mscdirect.com/product/details/42502823, Sep. 5, 2018, 2 pages.
U.S. Appl. No. 15/724,853, filed Oct. 4, 2017, August.

(56) References Cited

OTHER PUBLICATIONS

European Extended Search Report and Written Opinion for European Patent Application No. 17198971.8, Applicant: Superwinch, LLC., dated Mar. 20, 2018, 8 pages.

* cited by examiner

WINCHES WITH DUAL MODE REMOTE CONTROL, AND ASSOCIATED SYSTEMS AND METHODS

CROSS-REFERENCE TO RELATED APPLICATION

This application claims the benefit of and priority to U.S. Patent Application No. 62/414,909, filed Oct. 31, 2016, the disclosure of which is incorporated herein by reference in its entirety.

TECHNICAL FIELD

The present technology is directed to winches and, more specifically, to winches with remote controls, and associated systems and methods.

BACKGROUND

Winches are typically employed in situations where a vehicle is unable to negotiate an obstacle (e.g., mud or rocks) on its own. For example, a winch is typically used to help extract the vehicle and/or to stabilize the vehicle while negotiating steep terrain. As such, winching operations can involve heavy loads. Therefore, an operator typically employs a remote control to operate the winch while positioned away from the winch and cable.

BRIEF DESCRIPTION OF THE DRAWINGS

Embodiments of representative winches with dual mode remote controls described herein may be better understood by referring to the following Detailed Description in conjunction with the accompanying drawings, in which like reference numerals indicate identical or functionally similar elements.

Figure 1:
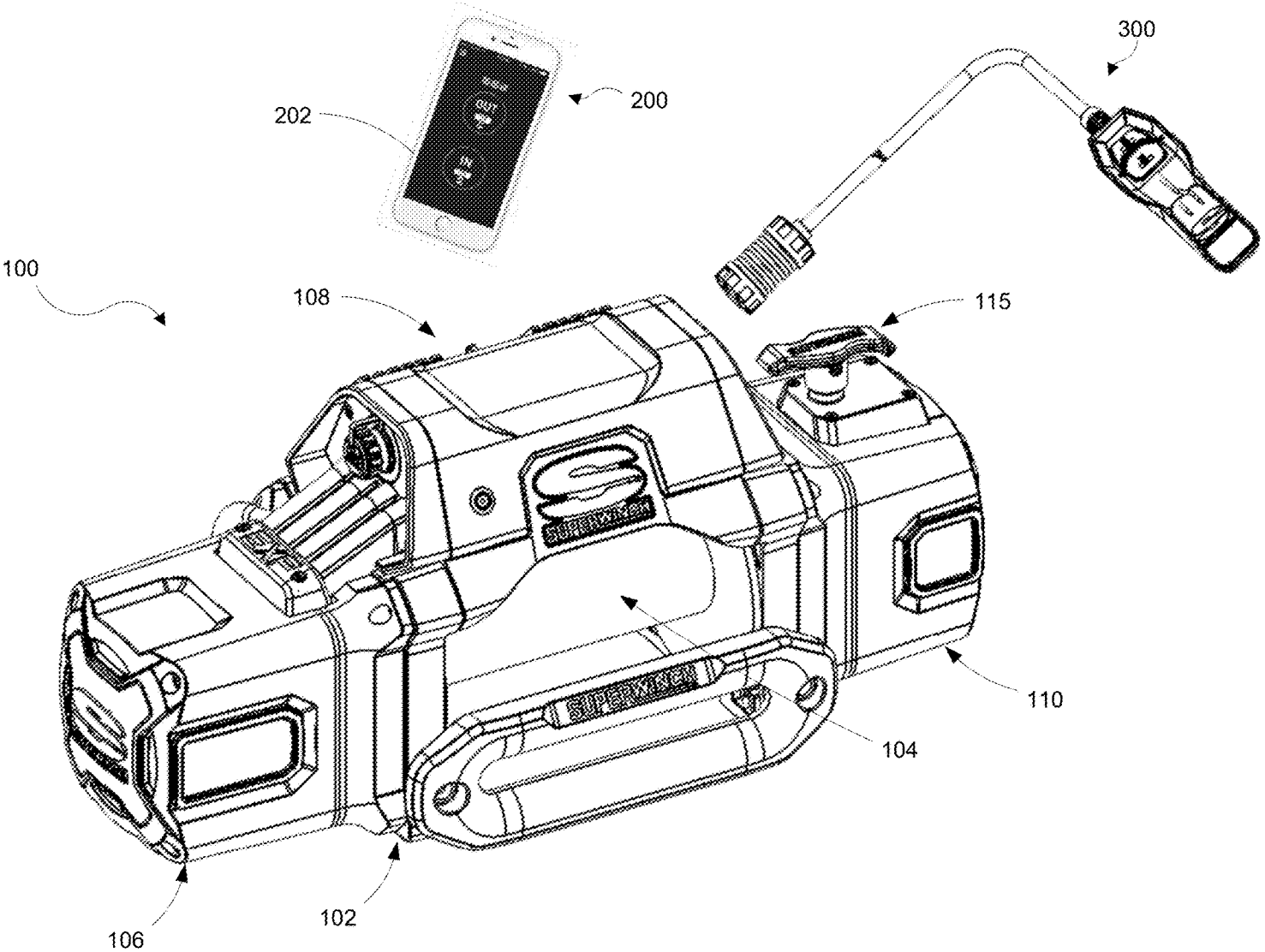
FIG. 1 is an isometric view of a winch with a dual mode remote control in accordance with some embodiments of the present technology as viewed from the left side.

The headings provided herein are for convenience only and do not necessarily affect the scope of the embodiments. Further, the drawings have not necessarily been drawn to scale. For example, the dimensions of some of the elements in the Figures may be expanded or reduced to help improve the understanding of the embodiments. Moreover, while the disclosed technology is amenable to various modifications and alternative forms, specific embodiments have been shown by way of example in the drawings and are described in detail below. The intention, however, is not to unnecessarily limit the embodiments described. On the contrary, the embodiments are intended to cover all suitable modifications, combinations, equivalents, and/or alternatives of the technology falling within the scope of this disclosure.

DETAILED DESCRIPTION

Overview

In some embodiments, representative winches with dual mode remote control can include a frame, a cable drum rotatably supported by the frame, a drive motor operatively connected to the cable drum, and a control module positioned adjacent the cable drum. The control module can include circuitry to interface with a remote control via one of two modes. In a wireless mode, the control module can communicate wirelessly with a wireless remote control (e.g., a cell phone). In a wired mode, the control module can communicate with a wired remote control. When the wired remote control is connected to the control module, a jumper wire in the wired remote control's connector completes a ground path circuit in the control module to disable the wireless capability of the control module. Disabling the wireless capability of the control module when the wired remote control is connected to the winch prevents conflicting commands from a wireless remote control that may be in the vicinity of the winch.

General Description

Various examples of the devices introduced above will now be described in further detail. The following description provides specific details for a thorough understanding and enabling description of these examples. One skilled in the relevant art will understand, however, that the techniques and technology discussed herein may be practiced without many of these details. Likewise, one skilled in the relevant art will also understand that the technology can include many other features not described in detail herein. Additionally, some well-known structures and/or functions may not be shown or described in detail below so as to avoid unnecessarily obscuring the relevant description.

FIG. 1 illustrates a winch 100 having dual mode remote control. The winch 100 can include a frame or frame assembly 102 that supports a drive motor 106 which powers a cable drum 104. The drive motor 106 drives the drum 104 through a gear train assembly 110. A clutch mechanism 115 engages and disengages the drum 104 from the gear train assembly 110 to facilitate quickly and easily unwinding the cable from the drum 104. An electrical module, such as a winch control module 108 can span across the cable drum 104 and houses control circuitry for the winch 100.

Figure 2:
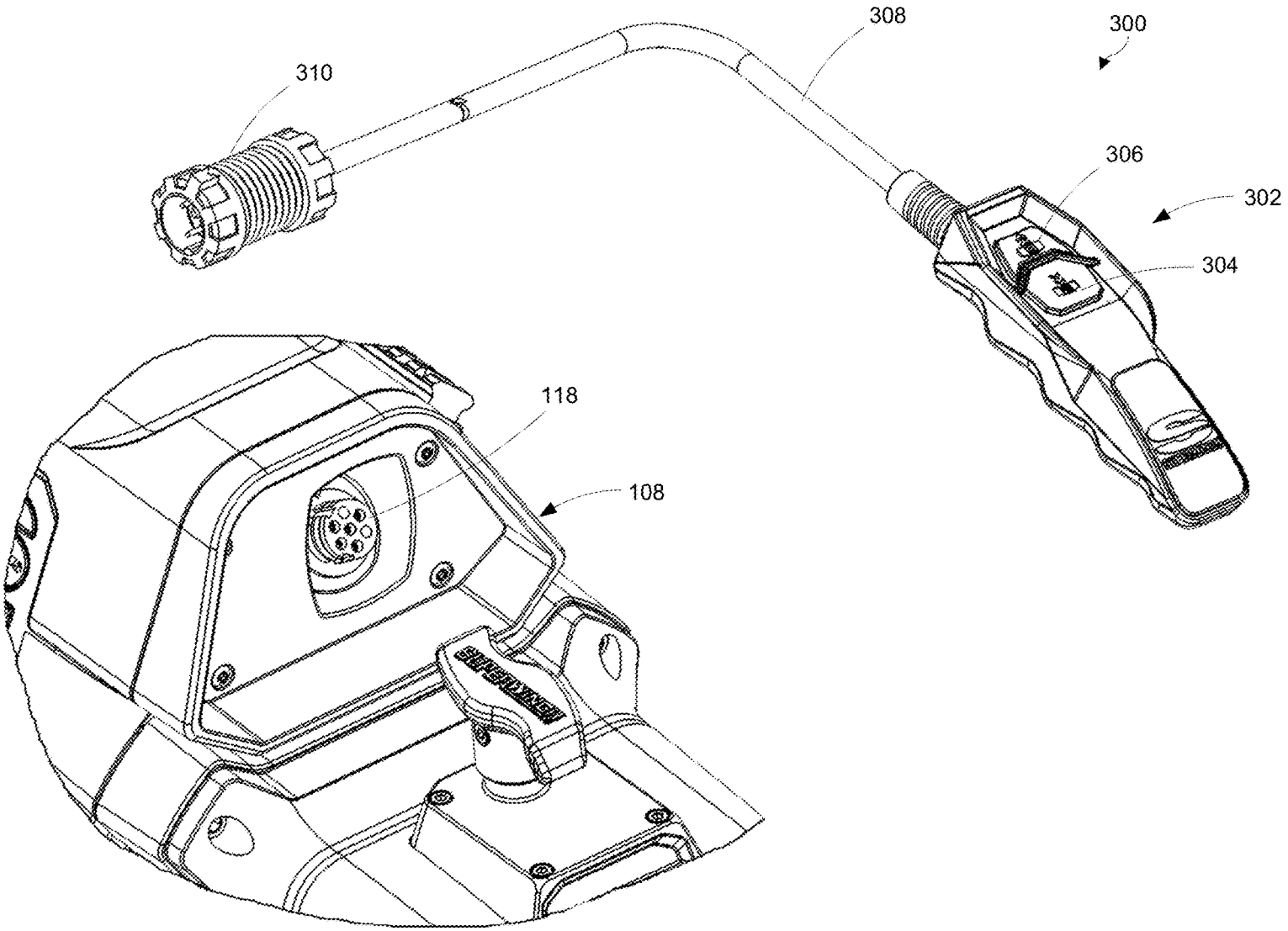
FIG. 2 is an isometric view of a portion of the winch shown in FIG. 1 as viewed from the right side.

The control module 108 can include circuitry to selectively interface with a remote control via either one of two modes depending on the circumstances. In a wireless mode, the control module 108 can communicate wirelessly with a wireless remote control 200. In a wired mode, the control module 108 can communicate with a wired remote control 300. In some embodiments, the wireless remote control 200 can comprise a cell phone or other suitable wireless device. In some embodiments, the wireless remote control 200 can include a software application having a graphical user interface (GUI) 202. With further reference to FIG. 2, the wired remote control 300 can include a housing 302 with winch-in and winch-out buttons 304 and 306, respectively. The wired remote control 300 can include a cable 308 and a remote connector 310. The wired remote control 300 connects to the control module 108 via the remote connector 310 and a mating module connector 118 mounted on the control module 108.

Figure 3:
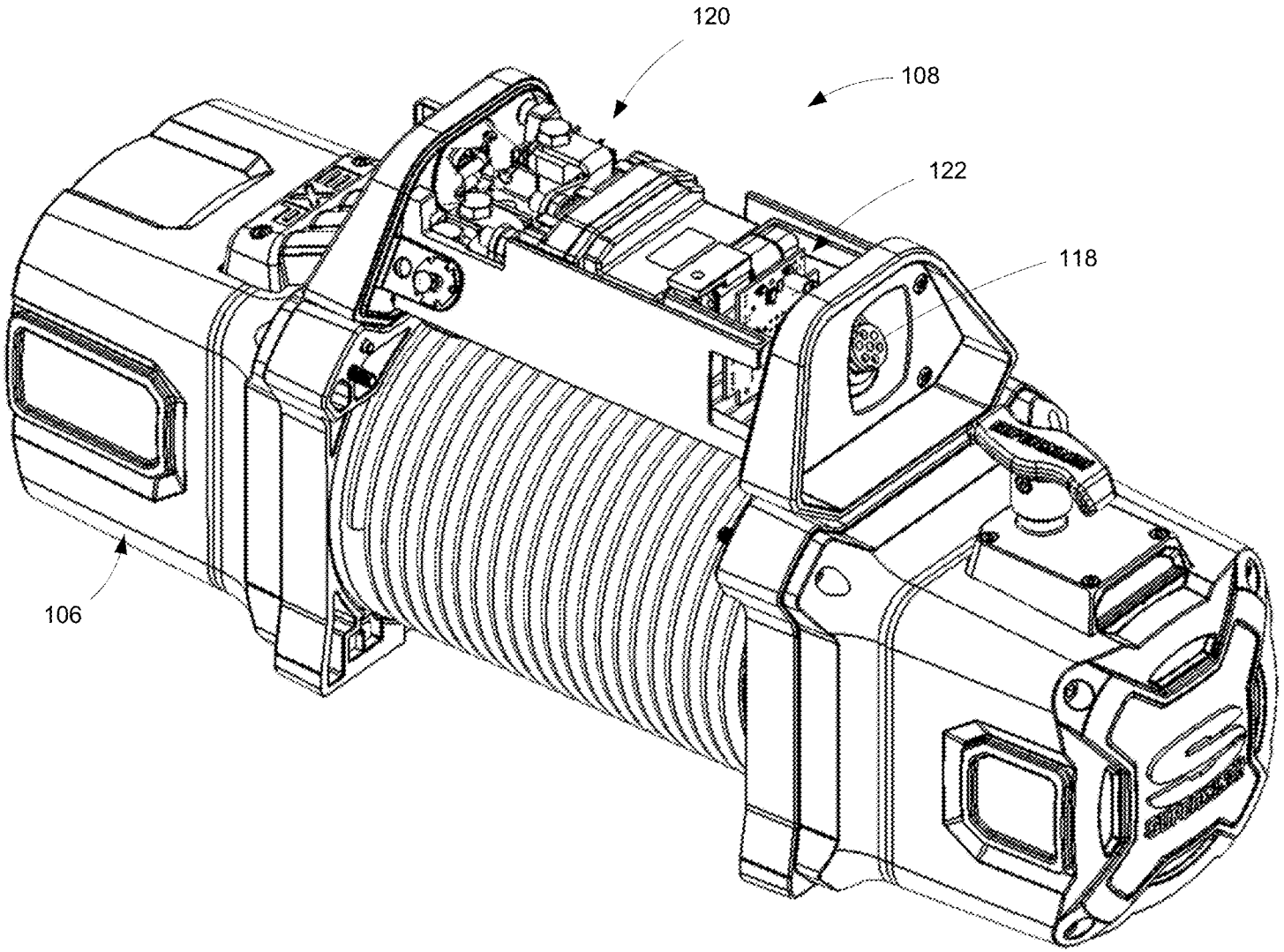
FIG. 3 is an isometric view of the winch shown in FIGS. 1 and 2 with the control module housing removed to illustrate a remote controller configured in accordance with some embodiments of the present technology.

As shown in FIG. 3, the control module 108 can include a contactor module 120 and a controller module 122.

Accordingly, the contactor module 120 and the controller module 122 can function as sub-modules of the overall, higher level control module 108. The contactor module 120 can include a switch that directs vehicle battery current to the drive motor 106 (FIG. 1). The contactor module 120 receives signals on low amperage coils from the controller module 122 to switch vehicle battery current to flow in one of two directions (e.g., forward or reverse) to the drive motor 106. The controller module 122 can operate in either the wireless mode or the wired mode. For example, the controller module 122 can receive a signal from a paired secured transmitter, e.g., the wireless remote control 200 (FIG. 1), to control the direction of the drive motor 106. Alternatively, the controller module 122 can be connected via the connector 118 to the wired remote control 300 (FIG. 2).

Figure 4:
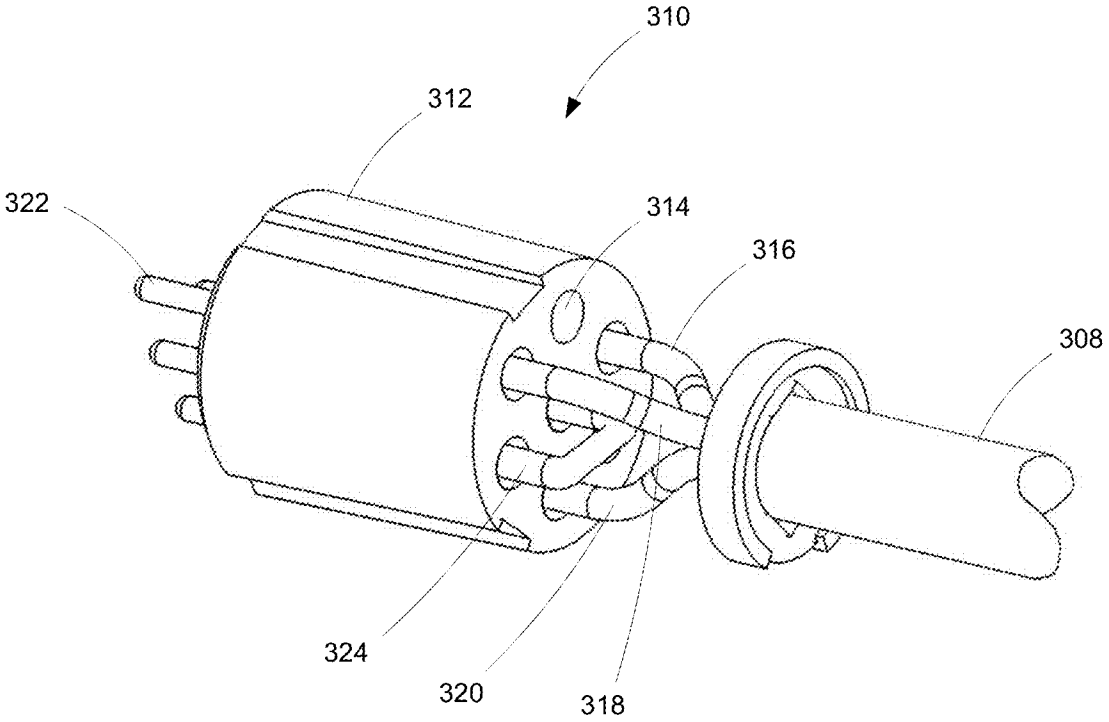
FIG. 4 is an isometric view of a remote control connector shown in FIGS. 1 and 2.

When operating in the wired mode, the connector 118 receives the corresponding remote connector 310 shown in FIG. 2. The remote connector 310 is shown in greater detail in FIG. 4 with the outer housing removed to show the internal components of the connector. The remote connector 310 can include a connector body 312 with a plurality of terminal apertures 314 extending therethrough. The cable 308 can include three control wires 316, 318, and 320 connected at one end to the winch-in and winch-out buttons 304 and 306 (FIG. 2) and connected at the other end to the connector body 312. The control wires 316, 318, and 320 extend into the terminal apertures 314 and connect to corresponding terminals 322. The remote connector 310 can also include a conductor, such as jumper wire 324, which functions to disable the wireless mode when the wired remote control 300 is connected to the controller module 122.

Figure 5:
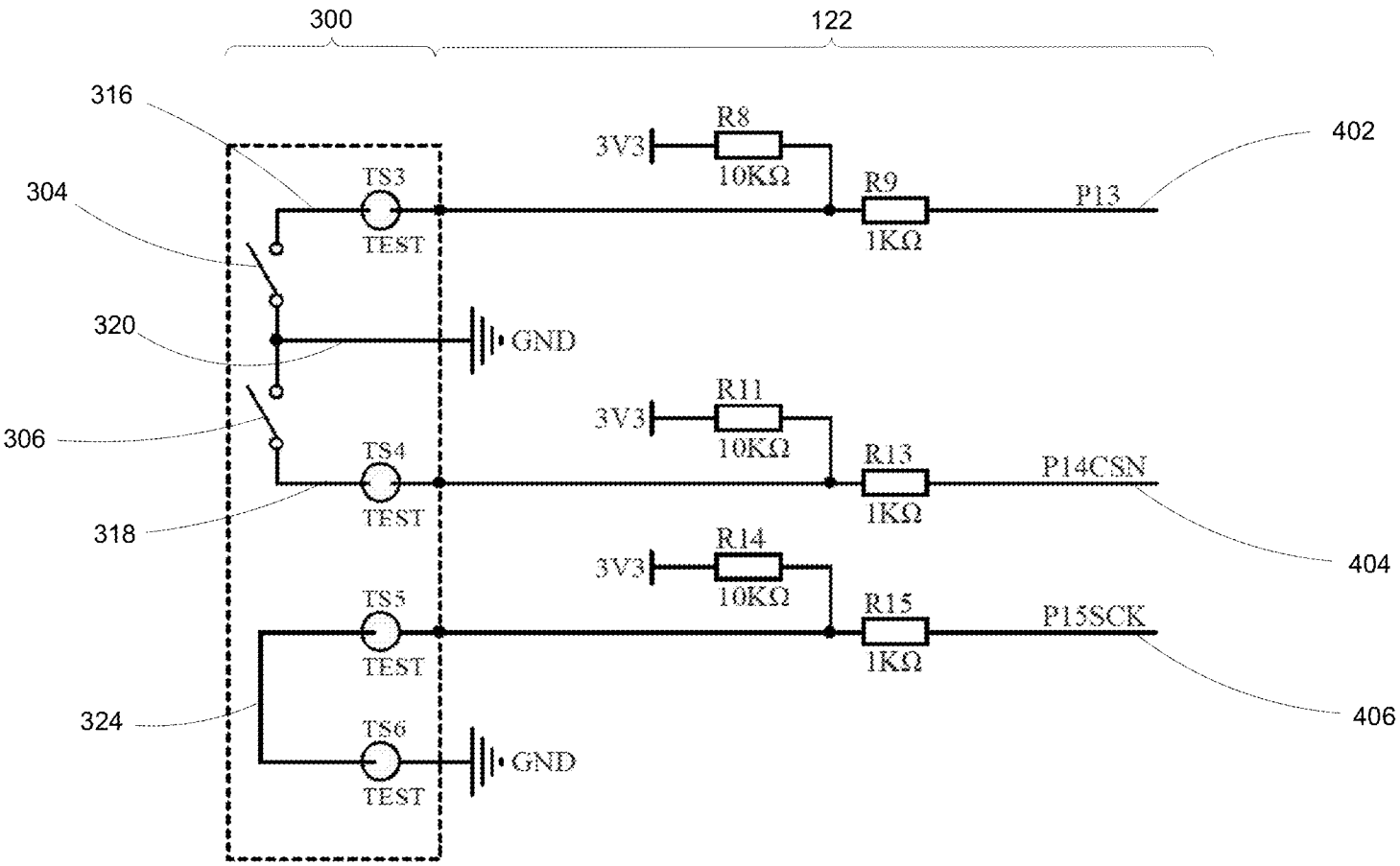
FIG. 5 is an electrical schematic of the remote control shown in FIGS. 1, 2, and 4.

With reference to FIG. 5, when the wired remote control 300 is connected to the controller module 122, the jumper wire 324 completes a normally open ground path connection on an enable/disable circuit 406 thereby pulling the circuit low. The control wires 316 and 318 connect to the winch-in and winch-out buttons 304 and 306, respectively. When one or the other of the winch-in and winch-out buttons 304 and 306 are pushed, a normally open ground path is completed, via control wire 320, on a corresponding winch-in circuit 402 or winch-out circuit 404, thereby pulling that circuit low.

Figure 6:
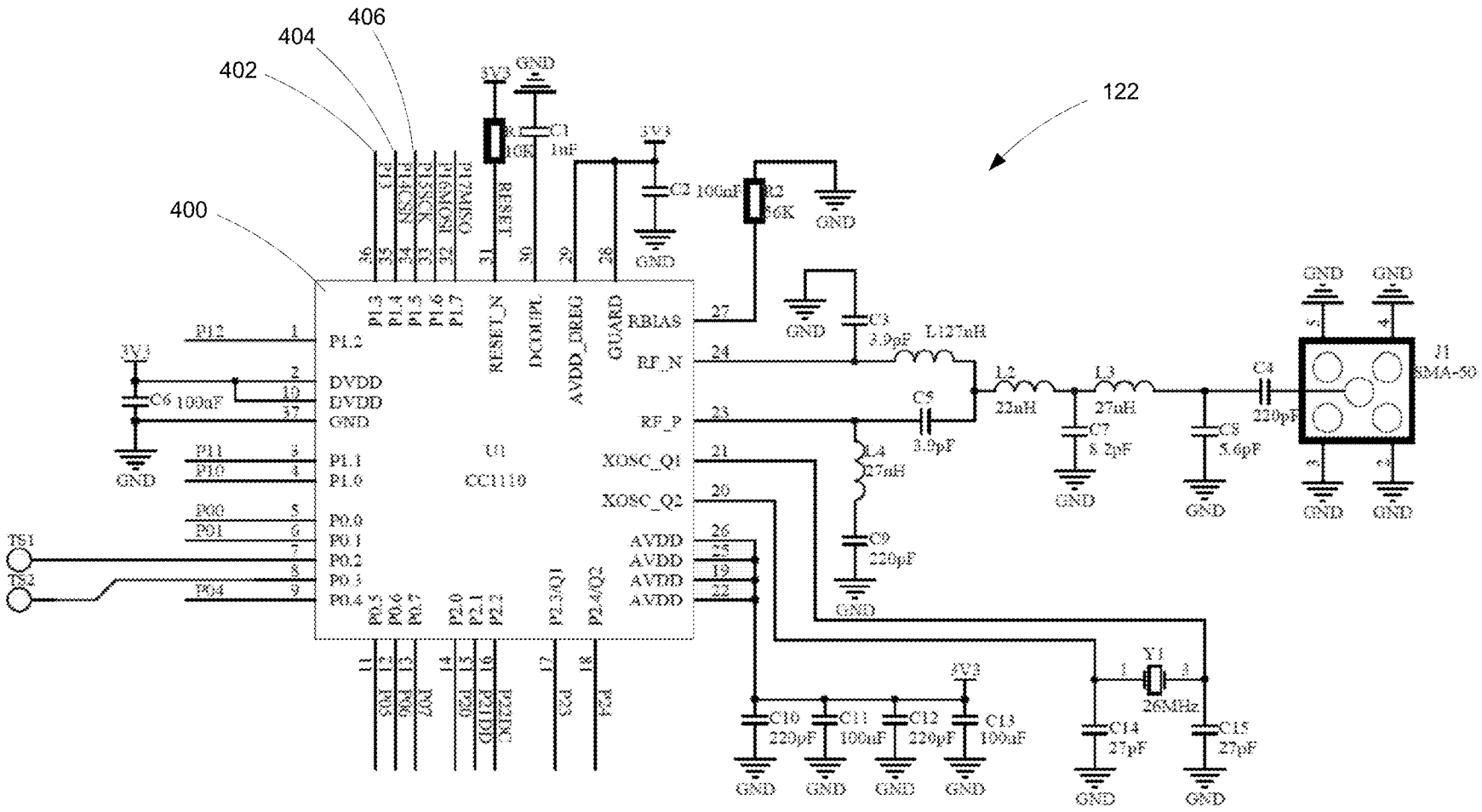
FIG. 6 is an electrical schematic of the remote controller shown in FIG. 3.

With further reference to FIG. 6, the winch-in, winch-out, and enable/disable circuits 402, 404, and 406 connect to corresponding control pins P13, P14, and P15 on a controller, such as a wireless-enablable microcontroller 400. When the microcontroller 400 registers a low state on pin P13 or pin P14, the microcontroller 400 directs the contactor module 120 (FIG. 3) to switch vehicle battery current to flow in one of two directions (e.g., forward or reverse) to the drive motor 106 (FIG. 3). When the microcontroller 400 registers a low state on control pin P15, the wireless capability of the microcontroller 400 is disabled. Disabling the wireless capability of microcontroller 400 when the wired remote control 300 is connected to the winch prevents conflicting commands from a wireless remote control that may be in the vicinity of the winch. In some embodiments, the controller can be a wireless-enablable system-on-chip microcontroller, such as microcontroller 400. In some embodiments, the controller can include separate processor, memory, and/or wireless transceiver modules, for example.

In some embodiments, the techniques introduced herein can be embodied as special-purpose hardware (e.g., circuitry), as programmable circuitry appropriately programmed with software and/or firmware, or as a combination of special-purpose and programmable circuitry. Hence, some embodiments may include a machine-readable medium having stored thereon instructions which may be used to program a computer, a microprocessor, processor, and/or microcontroller (or other electronic devices) to perform a process. The machine-readable medium may include, but is not limited to, optical disks, compact disc read-only memories (CD-ROMs), magneto-optical disks, ROMs, random access memories (RAMs), erasable programmable read-only memories (EPROMs), electrically erasable programmable read-only memories (EEPROMs), magnetic or optical cards, flash memory, or other type of media/machine-readable medium suitable for storing electronic instructions. In some embodiments, a suitable wireless-enablable microcontroller can comprise a Texas Instruments CC1110-CC1111 system-on-chip with low-power RF transceiver.

One feature of winches with dual mode remote control having configurations in accordance with the embodiments described herein is that connecting a wired remote control disables the wireless communication capability of the winch. An advantage of this arrangement is that a user can choose between wired or wireless control of the winch without having to perform any extra steps other than connecting or disconnecting the wired remote control to or from the winch. This arrangement provides the further advantage that the potential for conflicting signals from a wired remote and a wireless remote is eliminated.

The above description and drawings are illustrative and are not to be construed as limiting. Numerous specific details are described to provide a thorough understanding of the disclosure. However, in some instances, well-known details are not described in order to avoid obscuring the description. Further, various modifications may be made without deviating from the scope of the embodiments.

Reference in this specification to "one embodiment" or "an embodiment" means that a particular feature, structure, or characteristic described in connection with the embodiment is included in at least one embodiment of the disclosure. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various features are described which may be requirements for some embodiments but not for other embodiments.

The terms used in this specification generally have their ordinary meanings in the art, within the context of the disclosure, and in the specific context where each term is used. It will be appreciated that the same thing can be said in more than one way. Consequently, alternative language and synonyms may be used for any one or more of the terms discussed herein, and any special significance is not to be placed upon whether or not a term is elaborated on or discussed herein. Synonyms for some terms are provided. A recital of one or more synonyms does not exclude the use of other synonyms. The use of examples anywhere in this specification, including examples of any term discussed herein, is illustrative only and is not intended to further limit the scope and meaning of the disclosure or of any exemplified term. Likewise, the disclosure is not necessarily limited to the various embodiments provided in this specification. Unless otherwise defined, all technical and scientific terms used herein have the same meaning as commonly understood by one of ordinary skill in the art to which this disclosure pertains. In the case of conflict, the present document, including definitions, will control.

In some embodiments, a representative winch with dual mode remote control comprises a winch controller module including a wireless-enablable microcontroller and an enable/disable circuit connected to the microcontroller. The winch can further include a wired remote control including a remote connector connectable to the controller module, wherein the remote connector can include a jumper wire (or other conductor) operative to complete a ground path connection on the enable/disable circuit when the remote connector is connected to the controller module. The microcontroller can further include instructions operative to disable a wireless capability of the microcontroller when the ground path connection is completed. In some embodiments, other suitable arrangements can be used to disable the wireless communication link with the microcontroller, e.g., when a wired communication link is active.

In some embodiments, a representative winch with dual mode remote control comprises a frame, a cable drum rotatably supported by the frame, a drive motor operatively connected to the cable drum, and an electrical module positioned adjacent the cable drum. The electrical module can include a winch controller module including a wireless-enablable microcontroller and an enable/disable circuit connected to the microcontroller, wherein the microcontroller can include instructions operative to disable a wireless capability of the microcontroller when the ground path connection is completed. A wired remote control can include a remote connector connectable to the controller module, wherein the remote connector can include a jumper wire operative to complete a ground path connection on the enable/disable circuit when the remote connector is connected to the controller module.

In some embodiments, a representative method for controlling a winch having a wireless-enablable microcontroller comprises connecting the microcontroller to an enable/disable circuit having a normally open ground path connection; connecting the microcontroller to a winch-in circuit having a normally open ground path connection; connecting the microcontroller to a winch-out circuit having a normally open ground path connection; disabling a wireless capability of the microcontroller when the normally open ground path connection of the enable/disable circuit is completed; directing the contactor module to switch a current to flow to the drive motor in a first direction when the normally open ground path connection of the winch-in circuit is completed; and directing the contactor module to switch the current to flow to the drive motor in a second direction opposite the first when the normally open ground path connection of the winch-out circuit is completed. In some embodiments, the method can further comprise completing the normally open ground path connection of the enable/disable circuit by connecting a wired remote control to the winch.

The following examples provide additional embodiments of the present technology.

EXAMPLES

1. A winch, comprising:
a frame;
a cable drum rotatably supported by the frame;
a drive motor operatively connected to the cable drum; and a winch control module, including:
an enable/disable circuit having a normally open ground path connection; and
a controller having a wireless capability and being connected to the enable/disable circuit, the controller including instructions to disable the wireless capability of the controller when the normally open ground path connection is completed.

2. The winch of example 1, further comprising a winch-in circuit having a normally open ground path connection and a winch-out circuit having a normally open ground path connection.

3. The winch of example 1 or 2, wherein the winch control module further comprises a contactor module and the controller further comprises instructions to direct the contactor module to switch a current to flow to the drive motor in a first direction when the normally open ground path connection of the winch-in circuit is completed and to switch the current to flow to the drive motor in a second direction opposite the first when the normally open ground path connection of the winch-out circuit is completed.

4. The winch of any one of examples 1-3, wherein the controller comprises a wireless-enablable microcontroller.

5. The winch of any one of examples 1-4, further comprising a wired remote control, including:
a housing;
one or more control buttons; and
a remote connector connectable to the winch control module, wherein the remote connector includes a conductor positioned to complete the normally open ground path connection of the enable/disable circuit when the remote connector is connected to the winch control module.

6. The winch of any one of examples 1-5, wherein the one or more control buttons include a winch-in button and a winch-out button.

7. The winch of any one of examples 1-6, wherein the conductor comprises a jumper wire extending between a pair of corresponding terminals carried by the remote connector.

8. A winch system, comprising:
a winch, including:
a frame;
a cable drum rotatably supported by the frame;
a drive motor operatively connected to the cable drum; and
a winch control module, including:
an enable/disable circuit having a normally open ground path connection; and
a wireless-enablable microcontroller connected to the enable/disable circuit, the microcontroller including instructions to disable a wireless capability of the microcontroller when the normally open ground path connection is completed; and
a wired remote control, including:
a housing;
one or more control buttons; and
a remote connector connectable to the winch control module, wherein the remote connector includes a conductor positioned to complete the normally open ground path connection of the enable/disable circuit when the remote connector is connected to the winch control module.

9. The winch system of example 8, further comprising a winch-in circuit having a normally open ground path connection and a winch-out circuit having a normally open ground path connection.

10. The winch system of example 8 or 9, wherein the one or more control buttons include a winch-in button positioned to complete the normally open ground path connection of the winch-in circuit when pushed and a winch-out button positioned to complete the normally open ground path connection of the winch-out circuit when pushed.

11. The winch system of any one of examples 8-10, wherein the winch control module further comprises a contactor module and the microcontroller further comprises instructions to direct the contactor module to switch a current to flow to the drive motor in a first direction when the normally open ground path connection of the winch-in circuit is completed and to switch the current to flow to the drive motor in a second direction opposite the first when the normally open ground path connection of the winch-out circuit is completed.

12. The winch system of any one of examples 8-11, wherein the conductor comprises a jumper wire extending between a pair of corresponding terminals carried by the remote connector.

13. A winch system, comprising:

a winch, including:

a frame;

a cable drum rotatably supported by the frame;

a drive motor operatively connected to the cable drum; and a winch control module, including:

a contactor module; and a controller module, including:

an enable/disable circuit having a normally open ground path connection;

a winch-in circuit having a normally open ground path connection;

a winch-out circuit having a normally open ground path connection; and a wireless-enablable microcontroller connected to the enable/disable circuit, the winch-in circuit, and the winch-out circuit, the microcontroller including instructions to:

disable a wireless capability of the microcontroller when the normally open ground path connection of the enable/disable circuit is completed;

direct the contactor module to switch a current to flow to the drive motor in a first direction when the normally open ground path connection of the winch-in circuit is completed; and direct the contactor module to switch the current to flow to the drive motor in a second direction opposite the first when the normally open ground path connection of the winch-out circuit is completed; and a wired remote control, including:

a housing;

a remote connector connectable to the winch control module, wherein the remote connector includes a conductor positioned to complete the normally open ground path connection of the enable/disable circuit when the remote connector is connected to the winch control module;

a winch-in button positioned to complete the normally open ground path connection of the winch-in circuit when pushed; and a winch-out button positioned to complete the normally open ground path connection of the winch-out circuit when pushed.

14. The winch system of example 13, wherein the conductor comprises a jumper wire extending between a pair of corresponding terminals carried by the remote connector.

15. A method for controlling a winch having a wireless-enablable microcontroller, the method comprising:

connecting the microcontroller to an enable/disable circuit having a normally open ground path connection;

connecting the microcontroller to a winch-in circuit having a normally open ground path connection;

connecting the microcontroller to a winch-out circuit having a normally open ground path connection;

disabling a wireless capability of the microcontroller when the normally open ground path connection of the enable/disable circuit is completed;

directing the contactor module to switch a current to flow to the drive motor in a first direction when the normally open ground path connection of the winch-in circuit is completed; and direct the contactor module to switch the current to flow to the drive motor in a second direction opposite the first when the normally open ground path connection of the winch-out circuit is completed.

16. The method of example 15, further comprising completing the normally open ground path connection of the enable/disable circuit by connecting a wired remote control to the winch.

What is claimed is:

1. A winch, comprising: a frame; a cable drum rotatably supported by the frame; a drive motor operatively connected to the cable drum; and a winch control module, including: an enable/disable circuit having a normally open ground path connection; and a controller having a wireless capability and being connected to the enable/disable circuit, the controller including instructions to disable the wireless capability of the controller when the normally open ground path connection is completed, further comprising a wired remote control, including: a housing; one or more control buttons; and a remote connector connectable to the winch control module, wherein the remote connector includes a conductor positioned to complete the normally open ground path connection of the enable/disable circuit when the remote connector is connected to the winch control module.

2. The winch of claim 1, wherein the one or more control buttons include a winch-in button and a winch-out button.

3. The winch of claim 1, wherein the conductor comprises a jumper wire extending between a pair of corresponding terminals carried by the remote connector.

4. A winch system, comprising: a winch, including: a frame; a cable drum rotatably supported by the frame; a drive motor operatively connected to the cable drum; and a winch control module, including: an enable/disable circuit having a normally open ground path connection; and a wireless-enablable microcontroller connected to the enable/disable circuit, the microcontroller including instructions to disable a wireless capability of the microcontroller when the normally open ground path connection is completed; and a wired remote control, including: a housing; one or more control buttons; and a remote connector connectable to the winch control module, wherein the remote connector includes a conductor positioned to complete the normally open ground path connection of the enable/disable circuit when the remote connector is connected to the winch control module.

5. The winch system of claim 4, further comprising a winch-in circuit having a normally open ground path connection and a winch-out circuit having a normally open ground path connection.

6. The winch system of claim 5, wherein the one or more control buttons include a winch-in button positioned to complete the normally open ground path connection of the winch-in circuit when pushed and a winch-out button positioned to complete the normally open ground path connection of the winch-out circuit when pushed.

7. The winch system of claim 6, wherein the winch control module further comprises a contactor module and the microcontroller further comprises instructions to direct the contactor module to switch a current to flow to the drive motor in a first direction when the normally open ground path connection of the winch-in circuit is completed and to switch the current to flow to the drive motor in a second direction opposite the first when the normally open ground path connection of the winch-out circuit is completed.

8. The winch system of claim 4, wherein the conductor comprises a jumper wire extending between a pair of corresponding terminals carried by the remote connector.

9. A winch system, comprising: a winch, including: a frame; a cable drum rotatably supported by the frame; a drive motor operatively connected to the cable drum; and a winch control module, including: a contactor module; and a controller module, including: an enable/disable circuit having a normally open ground path connection; a winch-in circuit having a normally open ground path connection; a winch-out circuit having a normally open ground path connection; and a wireless-enablable microcontroller connected to the enable/disable circuit, the winch-in circuit, and the winch-out circuit, the microcontroller including instructions to: disable a wireless capability of the microcontroller when the normally open ground path connection of the enable/disable circuit is completed; direct the contactor module to switch a current to flow to the drive motor in a first direction when the normally open ground path connection of the winch-in circuit is completed; and direct the contactor module to switch the current to flow to the drive motor in a second direction opposite the first when the normally open ground path connection of the winch-out circuit is completed; and a wired remote control, including: a housing; a remote connector connectable to the winch control module, wherein the remote connector includes a conductor positioned to complete the normally open ground path connection of the enable/disable circuit when the remote connector is connected to the winch control module; a winch-in button positioned to complete the normally open ground path connection of the winch-in circuit when pushed; and a winch-out button positioned to complete the normally open ground path connection of the winch-out circuit when pushed.

10. The winch system of claim 9, wherein the conductor comprises a jumper wire extending between a pair of corresponding terminals carried by the remote connector.

* * * * *